US011519059B2

(12) United States Patent
Lian et al.

(10) Patent No.: US 11,519,059 B2
(45) Date of Patent: Dec. 6, 2022

(54) HIGH-STRENGTH HIGH-ELONGATION TINNED PRIMARY PLATE AND DOUBLE COLD REDUCTION METHOD THEREFOR

(71) Applicant: BAOSHAN IRON & STEEL CO., LTD., Shanghai (CN)

(72) Inventors: Fuliang Lian, Shanghai (CN); Bijun Ban, Shanghai (CN); Gaofei Liang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 236 days.

(21) Appl. No.: 16/303,779

(22) PCT Filed: May 26, 2017

(86) PCT No.: PCT/CN2017/086173
§ 371 (c)(1),
(2) Date: Nov. 21, 2018

(87) PCT Pub. No.: WO2017/219828
PCT Pub. Date: Dec. 28, 2017

(65) Prior Publication Data

US 2020/0318224 A1 Oct. 8, 2020

(30) Foreign Application Priority Data

Jun. 23, 2016 (CN) ..... 201610466945.1

(51) Int. Cl.
*C22C 38/28* (2006.01)
*C21D 8/02* (2006.01)
(Continued)

(52) U.S. Cl.
CPC ..... *C22C 38/28* (2013.01); *C21D 8/0205* (2013.01); *C21D 8/0226* (2013.01);
(Continued)

(58) Field of Classification Search
CPC ..... C21D 2211/003; C21D 2211/005; C21D 8/02; C21D 8/0205; C21D 8/0236;
(Continued)

(56) References Cited

U.S. PATENT DOCUMENTS 7,169,243 B2 1/2007 Bouzekri
7,501,031 B2 3/2009 Takeuchi et al.
(Continued)

FOREIGN PATENT DOCUMENTS

CN 101649381 A 2/2010
CN 101983251 A 3/2011
(Continued)

OTHER PUBLICATIONS

Reginald K. Asher, Sr., Tin Alloy Plating, Surface Engineering, vol. 5, ASM Handbook, Edited By C.M. Cotell, J.A. Sprague, F.A. Smidt, Jr., ASM International, 1994, p. 258-263, https://doi.org/10.31399/asm.hb.v05.a0001256. (Year: 1994).*
(Continued)

*Primary Examiner* — Nicholas A Wang
(74) *Attorney, Agent, or Firm* — Collard & Roe, P.C.

(57) ABSTRACT

A high-strength high-elongation tinned primary plate and a double cold reduction method therefor. The tinned primary plate comprises the following components by weight from 0.065 to 0.12% of carbon, from 0.2 to 0.8% of manganese, from 0.003 to 0.015% of nitrogen, the remainder being iron and the inevitable trace impurities. The tinned primary plate is necessarily subjected to double cold reduction at a reduction of 5~13% and a rolling tension of 50~100 MPa. The tinned primary plate has a yield strength of $Rp_{0.2}$≥520 MPa, and percentage elongations in rolling direction RD, 45° direction and perpendicular direction TD, which are all greater than or equal to 10% after bake-hardening.

6 Claims, 1 Drawing Sheet

(51) Int. Cl.

| | |
|---|---|
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |

(52) U.S. Cl.
CPC ..... *C21D 8/0236* (2013.01); *C21D 9/46* (2013.01); *C22C 38/001* (2013.01); *C22C 38/002* (2013.01); *C22C 38/04* (2013.01); *C22C 38/06* (2013.01); *C22C 38/20* (2013.01); *C22C 38/22* (2013.01); *C22C 38/26* (2013.01); *C21D 2211/003* (2013.01); *C21D 2211/005* (2013.01)

(58) Field of Classification Search
CPC ..... C21D 1/26; C21D 2211/008; C21D 2211/009; C21D 6/002; C21D 6/005; C21D 6/008; C21D 8/0226; C21D 8/0247; C21D 8/04; C21D 9/46
See application file for complete search history.

(56) References Cited

U.S. PATENT DOCUMENTS

| | | | | |
|---|---|---|---|---|
| 2009/0038718 | A1* | 2/2009 | Dotsch | C21D 8/02 148/530 |
| 2009/0250147 | A1 | 10/2009 | Nishida et al. | |
| 2011/0076177 | A1 | 3/2011 | Aratani et al. | |
| 2014/0305553 | A1* | 10/2014 | Masuda | C22C 38/002 148/603 |
| 2017/0051377 | A1* | 2/2017 | Saito | C22C 38/002 |

FOREIGN PATENT DOCUMENTS

| | | | | |
|---|---|---|---|---|
| CN | 102234736 | A | | 11/2011 |
| CN | 106086643 | A | | 11/2016 |
| EP | 1607490 | A1 | | 12/2005 |
| EP | 2 050 834 | A1 | | 4/2009 |
| EP | 2508641 | A1 | | 10/2012 |
| JP | S58151426 | A | | 9/1983 |
| JP | H10-110238 | A | | 4/1998 |
| JP | 2001073035 | | * | 3/2001 |
| JP | 2001107187 | A | | 4/2001 |
| JP | 2007-177315 | A | | 7/2007 |
| JP | 2007177315 | | * | 7/2007 |
| JP | 2009263789 | A | | 11/2009 |
| WO | 2008/018531 | A1 | | 2/2008 |
| WO | 2015/166646 | A1 | | 11/2015 |

OTHER PUBLICATIONS

Ghosh, P. et al. "Deep drawable steels." Automotive Steels. 2017. p. 113-141. (Year: 2017).*
International Search Report of PCT/CN2017/086173, dated Jul. 12, 2017.
European Communication Pursuant to Article 94(3) in European Application 17 814 566.0 dated Feb. 22, 2021.
Extended European Search Report in 17814566.0 dated Nov. 4, 2019.
European Communication Pursuant to Article 94(3) in European Application 17 814 566.0 dated Aug. 28, 2020.
Substantive Examination Report in Philippine Application No. 1/2018/502396 dated Sep. 9, 2020.
First Chinese Office Action in Chinese Application No. 201610466945.1 dated May 16, 2017 with English translation.
Standard Test Methods, Practices, and Terminology for Chemical Analysis of Steel Products, ASTM International, Designation: A 751-07a, United States, 6 pages.
First Office Action in Malaysian Application No. PI 2018001973 dated Feb. 11, 2022.

* cited by examiner

HIGH-STRENGTH HIGH-ELONGATION TINNED PRIMARY PLATE AND DOUBLE COLD REDUCTION METHOD THEREFOR

CROSS REFERENCE TO RELATED APPLICATIONS

This application is the National Stage of PCT/CN2017/086173 filed on May 26, 2017, which claims priority under 35 U.S.C. § 119 of Chinese Application No. 201610466945.1 filed on Jun. 23, 2016, the disclosure of which is incorporated by reference. The international application under PCT article 21(2) was not published in English.

TECHNICAL FIELD

The present invention relates to a manufacturing technology of a tinned plate, in particular to a high-strength high-elongation tinned primary plate and a double cold reduction (DCR) method therefor. The tinned primary plate has a yield strength $Rp_{0.2}$ of 520 MPa or more and elongations A of 10% or more in all three directions (rolling direction RD, 45° direction and perpendicular direction TD) after bake-hardening.

BACKGROUND OF THE INVENTION

At present, double cold reduction (DCR) has been widely used in the manufacture of tinned plates. Compared with the tinned plate obtained by single cold reduction (SCR) method, the tinned plate obtained by DCR has higher strength and thinner thickness, so that the thinning and cost reduction of materials of the cans and lids for foods, beverages and chemical industry can be effectively achieved. However, compared to SCR, the DCR method tends to result in lower elongations of the steel plate, especially in 45° direction and perpendicular direction TD. When used in the production of some parts requiring high elongation in various directions (e.g. easy-open lids and standard lids), before punching process, the baseplate is often necessarily to be subjected to a surface painting and baking process (baking temperature is about 200° C. and time is 10~30 min), which causes the elongation in various directions of baseplate to decrease due to bake-hardening. Therefore, the easy-open lids and the standard lids more likely crack during the punching in the direction having the lowest baseplate elongation. How to control the DCR process, to improve the strength of the tinned plate while ensuring the elongations of the baseplate in three directions (i.e. RD, 45° and TD) after bake-hardening, becomes a key question to expand the market application of the DCR tinned plate.

Currently, patents relating to the DCR method are published in China and other countries as follows:

U.S. Pat. No. 7,501,031B2 discloses a grade of steel, comprising the following components by weight from 0.003 to 0.005% of carbon, less than or equal to 0.04% of silicium, less than or equal to 0.6% of manganese, from 0.005 to 0.03% of phosphyorum, less than or equal to 0.02% of sulphu, more than or equal to 0.005~0.1% of aluminum, less than or equal to 0.005% of nitrogen. The grade of steel is suitable for both SCR and DCR methods. According to the patent, different steel plates with hardness level (HR30T) ranging from 61±3 to 76±3 can be obtained, and the Δr is relatively small.

Chinese Patent CN102234736A discloses a method for manufacturing a double cold-reduced tinned primary plate with high-strength and excellent isotropic property. In this patent, a DCR tinned primary plate with an HR30T of 60~80 and earing ratio of 5% or less is obtained by controlling conditions of hot rolling, single cold reduction, continuous annealing and double cold reduction of a low-carbon steel having alloy compositions by weight from 0.02 to 0.06% of carbon, less than or equal to 0.03% of silicium, from 0.10 to 0.30% of manganese, less than or equal to 0.015% of phosphyorum, less than or equal to 0.02% of sulphu, from 0.03 to 0.10% of aluminum, wherein the conditions of hot rolling are: heating temperature of 1180° C. or lower, finishing rolling temperature of $Ar_3$ or higher, coiling temperature of 620~750° C.; the reduction of single cold reduction of 75~90%; annealing at a temperature from 640° C. to 700° C. for a duration ranging from 50 seconds to 150 seconds. The reduction of double cold reduction is 15~35% double cold reduction Such high reduction of double cold reduction described in the above patents tends to result in an increase in the anisotropy and a great decrease in the lateral elongation of the final steel plate.

Chinese patent CN101649381A discloses a method for producing a DCR tinned primary plate, wherein a steel plate having advantages of thin thickness, high hardness, good corrosion resistance, and good deep-drawing processability is obtained by controlling conditions of single cold reduction (reduction of 85~90%), batch annealing (annealing temperature of 510~560° C.) and double cold reduction (reduction of 30~40%) of the manufacturing a low-carbon steel.

The batch annealing tends to obtain a combination of low strength and high elongation, while the double cold reduction section in the above patent has a high reduction. International patent WO2008/018531A1 discloses a method for manufacturing a DCR tinned primary plate, wherein, a DCR primary plate with an elongation in RD of 10% and an elongation in TD of 5% or greater is obtained by controlling manufacturing conditions of a low-carbon steel having compositions by weight from 0.02 to 0.06% of carbon, less than or equal to 0.03% of silicium, from 0.05 to 0.50% of manganese, less than or equal to 0.02% of phosphyorum, less than or equal to 0.02% of sulphu, from 0.02 to 0.10% of aluminum, from 0.008 to 0.015% of nitrogen wherein the manufacturing conditions are: heating temperature of 1200° C. or higher, coiling temperature of 600° C. or lower, single cold reduction of 80% or higher, double cold reduction of 6~15%.

U.S. Pat. No. 7,169,243B2 discloses a DCR material obtained by a continuous annealing stage with a cooling rate of 100° C. per second or more, which satisfies a relationship between the rupture strength Rm and the elongation in rolling direction A % of $(640\sim Rm)/10 \leq A\% \leq (700\sim Rm)/11$, where Rm is the maximum rupture strength of the steel, expressed in MPa.

SUMMARY OF THE INVENTION

The object of the present invention is to provide a high-strength high-elongation tinned primary plate and a double cold reduction method therefor. The tinned primary plate obtained by the method can ensure high yield strength and high elongations in the three directions of RD, 45° and TD after bake-hardening. The tinned primary plate has a yield strength of $Rp_{0.2} \geq 520$ MPa, and elongations in rolling direction RD, 45° direction and perpendicular direction TD, which are all greater than or equal to 10% after bake-hardening. The tinned primary plate is suitable for forming parts such as easy-open lids and standard lids.

In order to achieve the above object, the technical solutions of the present invention are as follows.

A high-strength high-elongation tinned primary plate, comprising the following components by weight from 0.065 to 0.12% of carbon, from 0.2 to 0.8% of manganese, from 0.01 to 0.08% of aluminum, from 0.003 to 0.015% of nitrogen, the remainder being iron and the inevitable trace impurities, the tinned primary plate is subjected to double cold reduction at a reduction of 5~13% and a rolling tension of 50~100 MPa.

Further, the tinned primary plate comprises one or more of the following component(s) by weight from 0.001 to 0.005% of boron, from 0.01 to 0.05% of chromium, from 0.001 to 0.1% of titanium, from 0.001 to 0.2% of niobium, from 0.001 to 0.2% of copper, from 0.002 to 0.008% of molybdenum.

Further, the tinned primary plate has a yield strength of $Rp_{0.2} \geq 520$ MPa, and elongations in rolling direction RD, 45° direction and perpendicular direction TD, which are all greater than or equal to 10% after bake-hardening.

The microstructure of the tinned primary plate is ferrite plus granular cementite with a banded distribution.

In the design of the steel composition of the present invention:

The carbon is dissolved in the material in the form of interstitial atoms or precipitated in the matrix as cementite, and acts as a solid solution strengthening and precipitation strengthening element on the steel plate to increase the yield strength of the steel plate. When the other components remain unchanged, the higher the carbon content is, the stronger the strengthening effect on the steel plate is obtained. Therefore, the carbon content of the tinned primary plate of the present invention is controlled to be 0.065% or more. However, a carbon content too high will lead to a lowered plasticity, which will adversely affect final processing property, isotropy, and especially aging resistance of the material. Therefore, the upper limit of the carbon content of the tinned primary plate of the present invention is controlled to be 0.12% or less.

The manganese is a strengthening and desulfurizing element in steel. However, the excessive content of Mn is unfavorable for stamping processability of the material. The Mn content of the steel of the present invention is controlled to be 0.2~0.8%.

The aluminum mainly acts as a deoxidizer in steel. And the nitrogen in the steel forms AlN with aluminum and precipitates, thereby eliminating the influence of the nitrogen on the aging properties of the steel. The aluminum content of the steel of the invention is controlled to be 0.01~0.08%. The solid solution of the nitrogen greatly increases the strength of the steel. However, if the nitrogen content is too high, the aging properties of the steel will be poor and the isotropy will be affected. The N content of the steel of the present invention is controlled to be 0.003% to 0.015%.

Further, the tinned primary plate comprises one or more of the following component(s) by weight from 0.001 to 0.005% of boron, from 0.01 to 0.05% of chromium, from 0.001 to 0.1% of titanium, from 0.001 to 0.2% of niobium, from 0.001 to 0.2% of copper, from 0.002 to 0.008% of molybdenum. Wherein, the addition of the boron element reduces the loss of elongation of the steel plate during baking-aging, and the addition of chromium, titanium, niobium, copper, molybdenum increases the strength of the steel plate. The above components can be added to fine-tune the properties of steel plate according to specific requirements of strength and elongation after baking-aging in practical applications.

Further, the tinned primary plate of the present invention needs to be subjected to double cold reduction at a reduction of 5~13% and a rolling tension of 50~100 MPa. Double cold reduction is often used to increase the yield strength of the steel plate. Generally, the reduction of double cold reduction is 15% or more. At such reduction, the microstructure is rolled into a band shape, and there is a higher dislocation density in the crystal grains. The dislocations are intersected with each other intensively during the movement, which increases the resistance, causes the deformation resistance to increase, and results in difficulty in plastic deformation, and ultimately leads to an increase in the strength of the steel plate and a decrease in the elongation. The increase in the reduction of double cold reduction particularly increases the anisotropy of the steel plate, and the elongation in a direction perpendicular to rolling direction is drastically deteriorated. Therefore, in order to ensure certain elongations in all directions while ensuring strengthening of the steel plate, the reduction of double cold reduction in the double cold reduction method of the present invention is controlled within a range of 5~13%.

The main role of the tension of double cold reduction is to control the shape of the rolled steel plate. Generally, the tension in double cold reduction is 110~150 MPa. Using a large tension is equivalent to applying a tensile deformation to the steel plate in the rolling direction and therefore the anisotropy of the steel plate tends to increase. In particular, the anisotropy after baking-aging of the DCR steel plate would be greatly influenced. The greater the tension is, the more obvious the decrease in the elongation perpendicular to the rolling direction after baking become. However, if the tension is too small, a good shape of the steel strip cannot be ensured. Therefore, the rolling tension of the double cold reduction in the present invention is controlled to be 50~100 MPa.

In the present invention, the alloy composition and the double cold reduction method are matched and unique to each other. In order to ensure the yield strength index after the double cold reduction of the tinned primary plate, the alloy compositions, such as two typical steel strengthening elements carbon and manganese are added for alloy strengthening in the composition design. Considering that the tinned primary plate needs to be baked before being used for preparing can or lid, a proper amount of nitrogen is added to the steel so that the yield strength of the tinned primary plate can be improved after aging. Meanwhile, in order to eliminate the adverse effect of nitrogen added in the steel on the elongation after aging and to ensure the purity of the steel, a proper amount of aluminum is added to the steel. The addition of other elements such as boron, chromium, titanium, niobium, copper, molybdenum can adjust the strengthening ability and baking-aging properties of the steel.

The composition determines the "potential" of the steel, and the double cold reduction method of the present invention exerts the "potential" of the steel.

The double cold reduction of the present invention improves the yield strength of the steel plate by making the advantage of the deformation of the steel plate, while controls the reduction in a lower range, thereby preventing the problem that steel plate elongation decreasing due to an overlarge reduction. The tension control in the double cold reduction is a major innovation of the present invention. The inventors found that when the tension is too large, the lateral elongation of the steel plate after baking-aging is greatly reduced. When the tension is 50~100 MPa, combined with a reduction of double cold reduction of 5~13%, it can be ensured that the double cold reduction can improve the yield strength of the steel plate without weakening elongation, especially the lateral elongation of the steel plate.

Based on the combination of the above two key technologies, the structure of the final obtained tinned primary plate is ferrite and banded-distributing cementite particles without solutionizing. The tinned primary plate has a yield strength of $Rp_{0.2} \geq 520$ MPa, and elongations in rolling direction RD, 45° direction and perpendicular direction TD, which are all greater than or equal to 10% after bake-hardening.

Further, the double cold reduction method for a high-strength high-elongation tinned primary plate of the present invention, the tinned primary plate comprises the following components by weight from 0.065 to 0.12% of carbon, from 0.2 to 0.12% of manganese, from 0.01 to 0.08% of aluminum, from 0.003 to 0.015% of nitrogen, the remainder being iron and the inevitable trace impurities; the primary plate is processed by double cold reduction at a reduction of 5~13% and a rolling tension of 50~100 MPa.

Further, the tinned primary plate comprises one or more of the following component(s) by weight from 0.001 to 0.005% of boron, from 0.01 to 0.05% of chromium, from 0.001 to 0.1% of titanium, from 0.001 to 0.2% of niobium, from 0.001 to 0.2% of copper, from 0.002 to 0.008% of molybdenum.

Preferably, the production steps of the tinned primary plate before double cold reduction are: converter steelmaking, continuous casting, hot rolling, pickling, single cold reduction and continuous annealing.

Preferably, the hot rolling steps of the steel plate before double cold reduction are: slab is heated to 1120° C. or higher, finishing rolling temperature is 840° C. or higher, and coiling temperature is 650° C. or lower Preferably, the reduction of single cold reduction before the double cold reduction of the tinned primary plate is 85%-90%.

Preferably, in the continuous annealing step before the double cold reduction of the tinned primary plate, the annealing temperature is 620~680° C.

The tinned primary plate has a yield strength of $Rp_{0.2}$520 MPa, and elongations in rolling direction RD, 45° direction and perpendicular direction TD, which are all greater than or equal to 10% after bake-hardening. The tinned primary plate has a microstructure of ferrite plus granular cementite with a banded distribution.

Before double cold reduction of the steel of the present invention:

In the hot rolling process, if the heating temperature is too low, the austenite in the steel cannot be completely recrystallized, thereby affecting the grain refinement after hot rolling; and the carbon and nitrogen elements cannot be effectively dissolved, which may affect the yield strength of the steel after the final double cold reduction. The hot rolling heating temperature of the steel of the present invention is suitably 1120° C. or higher.

If the finishing rolling temperature of the hot rolling is too low, a rolling under a two-phase zone of ferrite+austenite occurs, which easily leads to uneven grain in the final rolling, and finally affects the uniformity of the performances of the steel after double cold reduction. The finishing rolling temperature of hot rolling of the steel of the present invention is 840° C. or higher. If the coiling temperature of hot rolling is too high, the carbides aggregate and grow or form a coarse pearlite structure, resulting in a decrease in the strength of the steel of final double cold reduction. The coiling temperature of hot rolling of the steel of the present invention is suitably 650° C. or lower.

A single cold reduction is performed after hot rolling. A low reduction of the cold rolling will result in low yield strength of the final double cold-reduced steel, while an excessive reduction is unfavorable for isotropy and requires better equipment. The reduction of the single cold reduction of the steel of the present invention ranges from 85% to 90%. The annealing after cold rolling is a stage in which the internal stress in the steel is effectively eliminated, the isotropy of the steel is adjusted, and the grain recrystallization in the steel is promoted. If the temperature is too high, the strength of the steel is lowered, while if the temperature is too low, the recrystallization is insufficient, which affects the isotropy of the steel. The continuous annealing temperature of the steel of the present invention is 620~680° C.

Compared with prior arts, the present invention has the following outstanding beneficial effects:

The alloy composition of the steel grade of the present invention differs greatly from the steel grade having ultra-low carbon component disclosed in U.S. Pat. No. 7,501,031B2. In particular, the carbon content of the steel grade of the present invention is an order of magnitude higher than the steel grade disclosed in U.S. Pat. No. 7,501,031B2. As a strengthening element in steel, the difference in carbon inevitably leads to a large difference in the yield strength of the two steels of the same process. Moreover, the steel having ultra-low carbon in the above patent has strict requirements on steelmaking and inclusion control, while the steel having the composition of the present invention has low steelmaking cost and can control inclusion easily.

Chinese patent CN102234736A requires a high reduction of double cold reduction, and the alloy composition is quite different from that of the present invention. Moreover, the double cold reduction method disclosed in the present invention has a reduction significantly smaller than the above patent, and a low rolling tension will consume less energy. Such high reduction of double cold reduction tends to result in a large anisotropy and a greatly reduced elongation in lateral direction of the final steel plate. Compared with the batch continuous annealing process used in the Chinese patent CN101649381A, the annealing section of the tinned primary plate disclosed in the present invention uses a continuous annealing process. The steel plate of the present invention is fundamentally different from the steel plate obtained by batch annealing method in the above patent. Batch annealing tends to achieve a combination of low strength and high elongation, while continuous annealing has higher strength and lower elongation. And the difference between the reductions of double cold reduction of the two processes is also large. Moreover, the steel plate obtained by the continuous annealing process of the present invention has better performance stability, lower energy consumption and lower cost.

In addition, the final performance indexes of the steel plate obtained by the present invention are different from the above three patents, i.e. the above patents do not promise high elongation in all directions after baking-aging.

The alloy composition of the tinned primary plate disclosed in the present invention is greatly different from the International patent WO2008/018531A1. The tinned primary plate of the present invention can maintain an elongation in TD direction of more than 10% after bake-hardening, and has better performances. The invention controls the reduction of double cold reduction to 5~13% and the rolling tension to 50~100 MPa, thereby the obtained tinned primary plate has a yield strength of $Rp_{0.2} \geq 520$ MPa, and elongations in rolling direction RD, 45° direction and perpendicular direction TD greater than or equal to 10% after bake-hardening, which are superior to the said patent.

The method used by the present invention is completely different from U.S. Pat. No. 7,169,243B2. The high-speed annealing method in the U.S. patent has high requirements on equipment and is liable to cause a problem of poor plate shape in the production of the thin plate, which is disadvantageous for producing tinned primary plates of wide specification. The continuous annealing section of the tinned primary plate of the present invention has a temperature of 620~680° C., and the cooling section is cooled by conventional means, and there is no requirement for rapid cooling. The production method of the above patent is completely different from the present invention.

DETAILED DESCRIPTION

Figure 1:
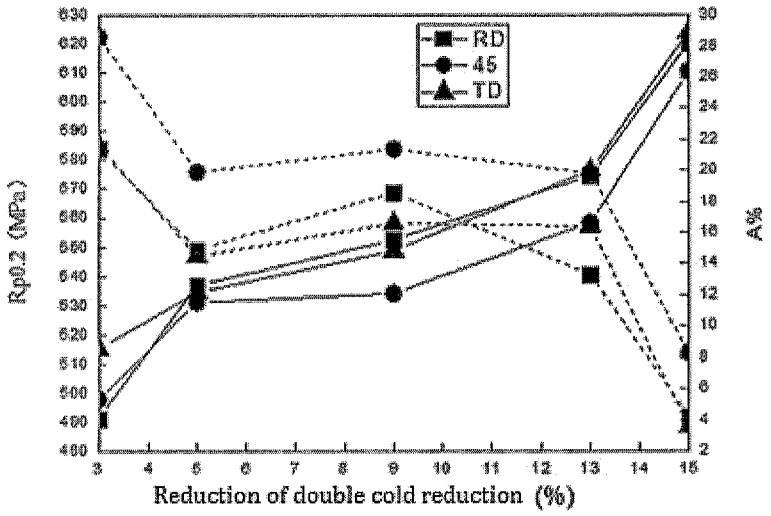
FIG. 1 is a schematic view showing the influence of the change of reduction of double cold reduction on the yield strength $Rp_{0.2}$ and the elongation A % in three directions of the steel plate after bake-hardening.

The invention will be described below by the Examples and the accompanying drawings.

Table 1 lists the alloy compositions of Examples 1~7 and Comparative Examples 1~2 of the present invention. Table 2 lists the processes before double cold reduction of the steel plate of Examples 1~7 and Comparative Examples 1~2 of the present invention.

Tables 3~5 show the properties of the Examples and Comparative Examples of the present invention after bake-hardening. Table 3 shows the properties after bake-hardening the steel plates obtained by double cold reduction of Example 1 using different reduction (Examples 1-1, 1-2, 1-3, Comparative Examples 1-1, 1-2). Table 4 shows the properties after bake-hardening of the steel plates obtained by double cold reduction using different tensions of Example 2 (Example 2-1, Comparative Example 2-1). Table 5 shows the properties after bake-hardening of the steel plates obtained by double cold reduction using different reduction and tensions of Examples 3~7 and Comparative Examples 1~4.

TABLE 1

Unit: mass percentage

| | C | Mn | Al | N | B | Cr | Ti | Nb | Cu | Mo |
|---|---|---|---|---|---|---|---|---|---|---|
| Example 1 | 0.08 | 0.3 | 0.01 | 0.005 | 0 | 0 | 0 | 0 | 0 | 0.005 |
| Example 2 | 0.12 | 0.3 | 0.03 | 0.015 | 0.002 | 0.03 | 0 | 0 | 0 | 0 |
| Example 3 | 0.08 | 0.8 | 0.05 | 0.007 | 0 | 0 | 0 | 0.01 | 0.02 | 0 |
| Example 4 | 0.10 | 0.6 | 0.06 | 0.005 | 0 | 0 | 0.005 | 0.005 | 0 | 0 |
| Example 5 | 0.12 | 0.6 | 0.03 | 0.010 | 0.002 | 0.02 | 0 | 0.005 | 0 | 0 |
| Example 6 | 0.07 | 0.4 | 0.03 | 0.012 | 0.002 | | 0.005 | 0 | 0.02 | 0 |
| Example 7 | 0.08 | 0.3 | 0.03 | 0.015 | 0.002 | 0.02 | 0.005 | 0 | 0 | 0 |
| Comparative Example 1 | 0.05 | 0.3 | 0.03 | 0.005 | 0 | 0 | 0 | 0.005 | 0 | 0 |
| Comparative Example 2 | 0.15 | 0.1 | 0.04 | 0.003 | 0.002 | 0 | 0 | 0 | 0 | 0 |
| Comparative Example 3 | 0.10 | 0.6 | 0.06 | 0.005 | 0.005 | 0 | 0 | 0.005 | 0 | 0 |
| Comparative Example 4 | 0.08 | 0.8 | 0.05 | 0.007 | 0 | 0.02 | 0 | 0.01 | 0 | 0 |

TABLE 2

| | Heating temperature ° C. | Finishing rolling temperature ° C. | Coiling temperature ° C. | Single cold reduction % | Continuous annealing temperature ° C. |
|---|---|---|---|---|---|
| Example 1 | 1180 | 860 | 600 | 88 | 670 |
| Example 2 | 1180 | 850 | 600 | 88 | 670 |
| Example 3 | 1180 | 860 | 640 | 86 | 670 |
| Example 4 | 1130 | 860 | 600 | 88 | 630 |
| Example 5 | 1150 | 860 | 640 | 88 | 670 |
| Example 6 | 1180 | 850 | 600 | 86 | 630 |
| Example 7 | 1130 | 860 | 640 | 88 | 670 |
| Comparative Example 1 | 1180 | 820 | 650 | 86 | 700 |
| Comparative Example 2 | 1180 | 840 | 600 | 88 | 620 |
| Comparative Example 3 | 1100 | 840 | 680 | 80 | 670 |
| Comparative Example 4 | 1180 | 860 | 650 | 88 | 600 |

TABLE 3

| | Double cold reduction (%) | Rolling tension (MPa) | Final thickness mm | Direction | Yield strength Rp0.2 | Elongation A % |
|---|---|---|---|---|---|---|
| Example 1-1 | 5 | 80 | 0.247 | RD | 536.9 | 14.9 |
| | | | | 45° | 531.1 | 19.9 |
| | | | | TD | 534.5 | 14.5 |
| Example 1-2 | 9 | | 0.237 | RD | 552.5 | 18.6 |
| | | | | 45° | 534.1 | 21.4 |
| | | | | TD | 548.7 | 16.6 |
| Example 1-3 | 13 | | 0.226 | RD | 574.6 | 13.3 |
| | | | | 45° | 558.3 | 19.8 |
| | | | | TD | 576.4 | 16.4 |
| Comparative Example 1-1 | 3 | | 0.252 | RD | 491.4 | 21.4 |
| | | | | 45° | 497.9 | 28.6 |
| | | | | TD | 515.1 | 21.6 |
| Comparative Example 1-2 | 15 | | 0.221 | RD | 620.2 | 4.2 |
| | | | | 45° | 610.5 | 8.3 |
| | | | | TD | 624.2 | 3.5 |

Remarks: The steel plates obtained by double cold reduction were baked at 200° C. for 30 min, and then the mechanical properties are measured. Mechanical properties were measured on tensile samples processed according to JIS5 standard. Rp0.2 is the stress at which 0.2% residual deformation occurs using as value of the yield strength, and A % is the elongation at break, and the gauge length is 50 mm.

TABLE 4

| | Double cold reduction (%) | Rolling tension (MPa) | Final thickness mm | Direction | Yield strength Rp0.2 | Elongation A % |
|---|---|---|---|---|---|---|
| Example 2-1 | 13 | 100 | 0.226 | RD | 572.3 | 13.1 |
| | | | | 45° | 555.4 | 18.5 |
| | | | | TD | 581.2 | 13.5 |
| Comparative Example 2-1 | | 120 | 0.226 | RD | 578.2 | 12.8 |
| | | | | 45° | 560.1 | 18.5 |
| | | | | TD | 585.4 | 8.9 |

Remarks: The steel plates obtained by double cold reduction were baked at 200° C. for 30 min, and then the mechanical properties are measured. Mechanical properties were measured on tensile samples processed according to JIS5 standard. Rp0.2 is the stress at which 0.2% residual deformation occurs using as value of the yield strength, and A % is the elongation at break, and the gauge length is 50 mm.

TABLE 5

| | Double cold reduction (%) | Rolling tension (MPa) | Final thickness mm | Direction | Yield strength Rp0.2 | Elongation A % |
|---|---|---|---|---|---|---|
| Example 3 | 8 | 80 | 0.245 | RD | 563.9 | 14.8 |
| | | | | 45° | 552.8 | 17.6 |
| | | | | TD | 578.3 | 14.5 |
| Example 4 | 8 | 80 | 0.230 | RD | 560.4 | 13.5 |
| | | | | 45° | 552.3 | 18.8 |
| | | | | TD | 570.2 | 15.4 |
| Example 5 | 13 | 80 | 0.220 | RD | 592.8 | 12.8 |
| | | | | 45° | 589.0 | 14.7 |
| | | | | TD | 598.4 | 11.9 |
| Example 6 | 13 | 50 | 0.220 | RD | 585.4 | 13.1 |
| | | | | 45° | 575.3 | 15.2 |
| | | | | TD | 588.3 | 12.5 |
| Example 7 | 8 | 100 | 0.232 | RD | 568.2 | 14.8 |
| | | | | 45° | 549.2 | 18.9 |
| | | | | TD | 567.4 | 13.6 |
| Comparative Example 1 | 10 | 60 | 0.221 | RD | 513.5 | 21.8 |
| | | | | 45° | 500.4 | 27.3 |
| | | | | TD | 530.5 | 20.9 |
| Comparative Example 2 | 8 | 120 | 0.240 | RD | 589.8 | 3.9 |
| | | | | 45° | 576.8 | 7.5 |
| | | | | TD | 594.6 | 5.0 |
| Comparative Example 3 | 8 | 60 | 0.220 | RD | 523.5 | 22.8 |
| | | | | 45° | 510.4 | 23.2 |
| | | | | TD | 520.4 | 18.5 |
| Comparative Example 4 | 8 | 80 | 0.231 | RD | 618.4 | 5.2 |
| | | | | 45° | 612.7 | 5.4 |
| | | | | TD | 632.2 | 5.8 |

FIG. 1 shows the influence of the change of reduction of double cold reduction on the yield strength $Rp_{0.2}$ and the elongation A % in three directions of the steel plate after bake-hardening. FIG. 1 is based on Examples 1-1, 1-2, 1-3, and Comparative Examples 1-1, 1-2. The solid line in the Figure is the curve of $Rp_{0.2}$, and the dotted line is the curve of A %. As the reduction of double cold reduction increases, the strength increases while the elongations in three directions decrease.

Figure 2:
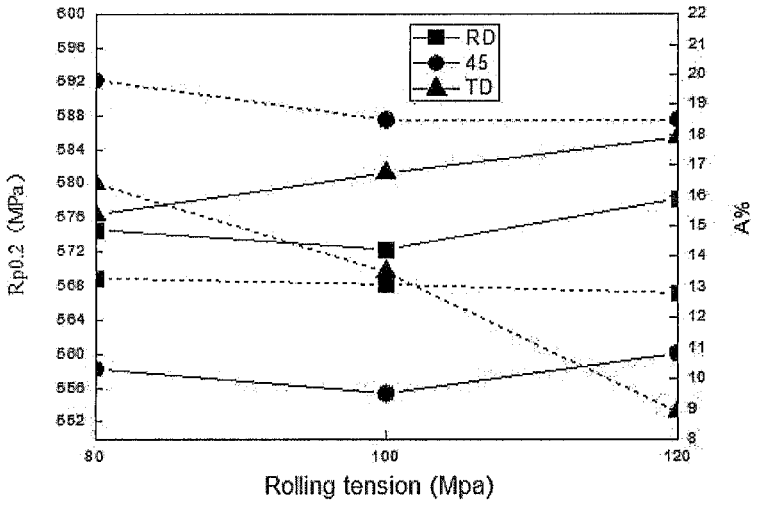
FIG. 2 is a schematic view showing the influence of the rolling tension on the yield strength $Rp_{0.2}$ and the elongation A % in three directions of the steel plate after bake-hardening.

FIG. 2 shows the influence of the rolling tension on the yield strength $Rp_{0.2}$ and the elongation A % in three directions of the steel plate after bake-hardening. FIG. 2 is based on Examples 1-3, 2-1, and Comparative Example 2-1. The solid line in the Figure is the curve of $Rp_{0.2}$, and the dotted line is the curve of A %. The most obvious effect of the increase in rolling tension is that the elongation in TD direction is drastically reduced.

The invention claimed is:

1. A tinned plate, consisting of:

0.065 to 0.12 wt % of carbon, 0.2 to 0.8 wt % of manganese, 0.01 to 0.08 wt % of aluminum, 0.003 to 0.015 wt % of nitrogen, at least one of 0.001 to 0.005 wt % of boron or, 0.01 to 0.03 wt % of copper; and one or more of the following component(s): 0.01 to 0.05 wt % of chromium, 0.001 to 0.1 wt % of titanium, 0.001 to 0.2 wt % of niobium, 0.002 to 0.008 wt % of molybdenum, the remainder being iron and inevitable trace impurities, wherein the tinned plate is subjected to double cold reduction at a reduction of 5-13% and a rolling tension of 50-100 MPa; wherein the microstructure of the tinned plate consists of ferrite and granular cementite with a banded distribution;

wherein, the tinned plate has a yield strength of $Rp_{0.2} \geq 520$ MPa, and percentage elongations A % in rolling direction RD, 45 degree direction and perpendicular direction TD, which are all greater than or equal to 10% after bake-hardening.

2. A double cold reduction method for a tinned plate, wherein the tinned plate consists of:

0.065 to 0.12 wt % of carbon, 0.2 to 0.8 wt % of manganese, 0.01 to 0.08 wt % of aluminum, 0.003 to 0.015 wt % of nitrogen, at least one of 0.001 to 0.005 wt % of boron or, 0.01 to 0.03 wt % of copper; and one or more of the following component(s): 0.01 to 0.05 wt % of chromium, 0.001 to 0.1 wt % of titanium, 0.001 to 0.2 wt % of niobium, 0.002 to 0.008 wt % of molybdenum, the remainder being iron and inevitable trace impurities, wherein the tinned plate is subjected to double cold reduction at a reduction of 5-13% and a rolling tension of 50-100 MPa;

wherein the microstructure of the tinned plate consists of ferrite and granular cementite with a banded distribution;

wherein, the tinned plate has a yield strength of $Rp_{0.2} \geq 520$ MPa, and percentage elongations A % in rolling direction RD, 45 degree direction and perpendicular direction TD, which are all greater than or equal to 10% after bake-hardening.

3. The double cold reduction method according to claim 2, wherein, prior to the step of double cold reduction, steps for production of the tinned plate comprise converter steelmaking, continuous casting, hot rolling, pickling, single cold reduction and continuous annealing.

4. The double cold reduction method according to claim 3, wherein, the tinned plate is subjected to hot rolling before double cold reduction, wherein slab is heated to 1120° C. or higher, finishing rolling temperature is 840° C. or higher, and coiling temperature is 650° C. or lower.

5. The double cold reduction method according to claim 3, wherein, the tinned plate is subjected to the single cold reduction, before the double cold reduction, at a reduction of 85-90%.

6. The double cold reduction method according to claim 3, wherein, the tinned plate is subjected to the continuous annealing, before double cold reduction, at an annealing temperature of 620-680° C.

* * * * *